United States Patent [19]

Fingerle et al.

[11] 4,210,051

[45] Jul. 1, 1980

[54] BAND KNIFE SPLITTING MACHINE FEED ROLL ARRANGEMENT

[75] Inventors: Karl Fingerle, Korb; Gerd Lotzwik, Stuttgart, both of Fed. Rep. of Germany

[73] Assignee: Fortuna-Werke Maschinenfabrik GmbH, Stuttgart-Bad Canstatt, Fed. Rep. of Germany

[21] Appl. No.: 947,167

[22] Filed: Sep. 28, 1978

[51] Int. Cl.[2] ..... B26D 1/46

[52] U.S. Cl. ..... 83/871; 83/436; 83/813; 69/13

[58] Field of Search ..... 69/9, 13, 36; 83/435, 83/436, 661, 813, 877, 861, 871; 193/35 B, 37; 198/782

[56] References Cited

U.S. PATENT DOCUMENTS

| | | | |
|---|---|---|---|
| 2,664,923 | 1/1954 | Ferrari | 83/661 X |
| 3,690,203 | 9/1972 | Huttemann | 83/861 |
| 3,736,776 | 6/1973 | Repetto | 69/13 |

*Primary Examiner*—James G. Smith
*Attorney, Agent, or Firm*—Martin A. Farber

[57] ABSTRACT

A band knife splitting machine with two superposed feed rolls and an endless moving band knife. The two feed rolls are respectively journalled at the ends of two intersecting pivoting levers and the end of the lever for the lower feed roll is pivoted above the plane of cutting while the end of the lever for the upper feed roll is pivoted below the cutting plane.

7 Claims, 2 Drawing Figures

BAND KNIFE SPLITTING MACHINE FEED ROLL ARRANGEMENT

The invention relates to a band knife splitting machine feed roll arrangement and more particularly a means for carrying such feed rolls.

Splitting machines for splitting soft materials such as leather, rubber and the like with an endless moving band knife have already been proposed. In the case of such machines the knife is guided in a manner free of play by means of guide rails along a path, whose length substantially corresponds to the working breadth of the machine. In the machine the material to be split is fed or advanced in its plane by two oppositely driven feed rolls, placed one above the other, towards the cutting edge of the endless moving band knife. The two feed rolls are for this purpose arranged to be adjusted in a direction perpendicular to the plane of cutting by the use of screw rods connected with them and furthermore the lower roll is pressed by spring means against the lower side of the material to be split in order to allow for any unevenesses in this material. In order to be able to adjust the compression or thrust zone, necessary for satisfactory cutting, and extending between the cutting edge of the knife and the points at which the upper and lower rolls make nipping engagement with the two sides of the material corresponding to a perpendicular line of action with respect to the material and, by virtue of this adjustment, to be able to avoid deflection of the band knife, the rolls must also be adapted to be moved parallel to the cutting plane and held in the position in which they have been moved. Such adjustment is necessary to suit different types of material to be split, that is to say to take into account the thickness and hardness of it, and when the thickness of the material is less the thrust zone necessary for optimum cutting is also smaller. The shifting of the rolls and simultaneous fixing in position for the optimum setting of the thrust zone along these lines is carried out conventionally by placing spacing sleeves or the like between the attachment flanges of the longitudinal axes of the advancing rolls and a fixed abutment point on the frame of the machine.

In accordance with another previously proposed type of machine the lower advance or feed roll is carried on a pivoting lever, which is spring loaded and has a fulcrum point below the splitting knife. It is a disadvantage in this respect that in the case of thick split off portions from the material, which drop down, the band knife is excessively loaded at the tangential point of the lower feed roll.

Finally in accordance with a further prior art arrangement for splitting very thin materials, for example with a thickness of below 1 mm, a straight edge guide is used in lieu of an upper feed roll.

In the case of all these known band knife splitting machines the split off pieces of material, which are removed in an upward direction constitute the product, that is to say pieces of material, which can be used and are capable of further processing, while the split off pieces or shavings, which fall down are either reject material or are materials which can only be used after further splitting. It is a disadvantage in this respect that such reject material always has to be sorted out from the reject material container under the machine, this being a time consuming and monotonous operation.

One aim of the invention is that of mounting the feed roll in the case of such a band knife splitting machine that the initially mentioned disadvantages of previously proposed arrangements are avoided, in particular the excessive loading of the band knife at its face immediately adjacent to the cutting edge by split off material can be avoided without any time consuming fitting of different spacing sleeves or the like in order to set the optimum thrust zone.

A further aim of the invention is that of permitting convenient further splitting of material, which in the prior art after being split for the first time dropped downwards, by causing such material to be ejected in an upwards direction.

In accordance with the invention this is to be ensured in the case of a splitting machine of the type described by the feature that the two feed rolls are respectively journalled at the ends of two intersecting pivoting levers and the end of the lever for the lower feed roll is pivoted above the plane of cutting while the end of the lever for the upper feed roll is pivoted below the cutting plane. In this respect it is an advantage if the pivot points of the intersecting pivoting levers are so arranged that for the lever of the upper advance roll the pivot point is arranged in or below the projected plane of the top surface of the band knife immediately adjacent to the cutting edge and for the lever of the lower feed roll the pivot point is in or above the projected plane of the top surface of the band knife immediately adjacent to the cutting edge, in each case with respect to the cutting plane.

Further advantages and features of the invention will become apparent from the following description of an embodiment of the invention referring to the accompanying drawings.

Figure 1:
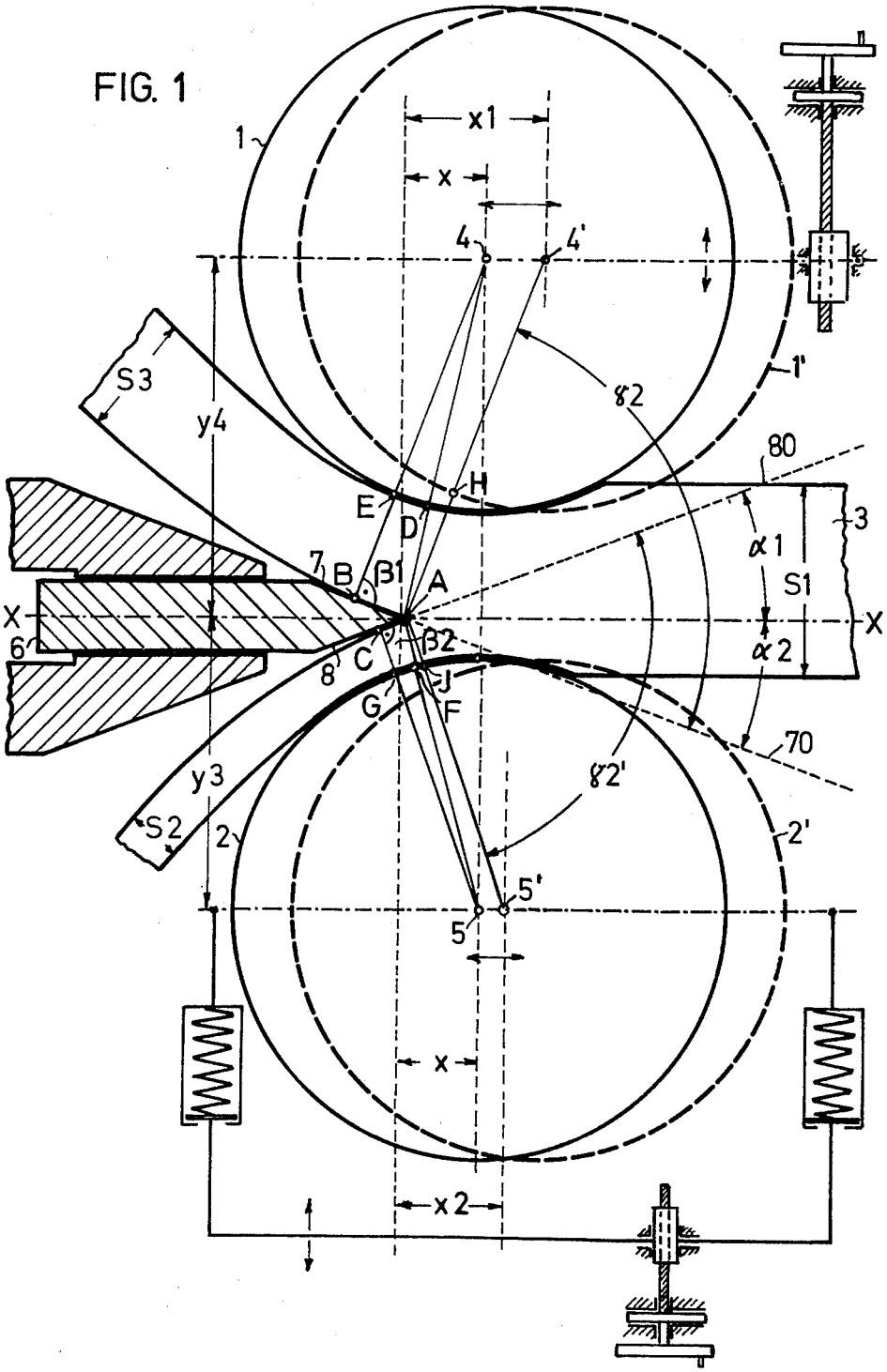
FIG. 1 shows diagrammatically an arrangement of the means supporting the advance or feed rolls in a band knife cutting machine in accordance with the prior art, in which there is an excessive load on the knife.

In a conventional manner in a band knife splitting machine an upper feed or advance roll 1 and a lower feed roll 2, lying above and below a material 3 to be split, have the pivot points 4 and 5 for the upper and lower rolls arranged one above the other, see FIG. 1. In the triangle between the points E-A-B the angle beta 1 is equal to 90° and in the triangle G-A-C the angle beta 2 is also equal to 90° this being so in the case of the oblique angles of the band knife 6 made by the band knife faces 7 and 8 adjacent to cutting edge and the oblique faces 70 and 80 respectively with the planes X—X as the angles of alpha 1 and alpha 2. The angles alpha 1 and alpha 2 are preferably of the same size. A shaved off piece S3 makes tangential contact with the feed roll 1 at the point D. In the right angle triangle E-B-A the distance between the point Dand the point A is larger than the distance between the point E and the point B. By the same token in the right angle triangle G-C-A the distance between the point F and the band knife cutting edge A is greater than the distance between the point G on the feed roll 2 and the point C on the band knife 6. As a result the shaved off pieces S3 and S2 exert an undue force on the band knife 6 at the point B and at the point C.

In order now to prevent a loading of the band knife 6 at the point B owing to the thickness of the shaved off piece S3 and at the point C by the thickness of the shaved off piece S2, at least the distance x, that is to say the distance from the center point 4 of the feed roll 1 and from the center point 5 of the feed roll 2 to a distance from the band knife cutting edge A at least in the case of the advance roll 1' must be increased to $x^1$ and in the case of the advance roll 2' it must be increased to $x^2$ so that the shortest distance between the point H and the band knife cutting edge A is achieved in the case of the advance roll 1' and the shortest distance is achieved between the point J and the band knife cutting edge A. The angles gamma 2 and gamma 2', which result after displacement of the upper and lower rolls 1 and 2 and their center points 4' and 5' away from the band knife cutting edge A by the distance $x^1$ and which on the one hand are enclosed by the connecting line A4' and A5' and on the other hand by the plane 70 and 80 respectively, should not be greater than 90°.

Figure 2:
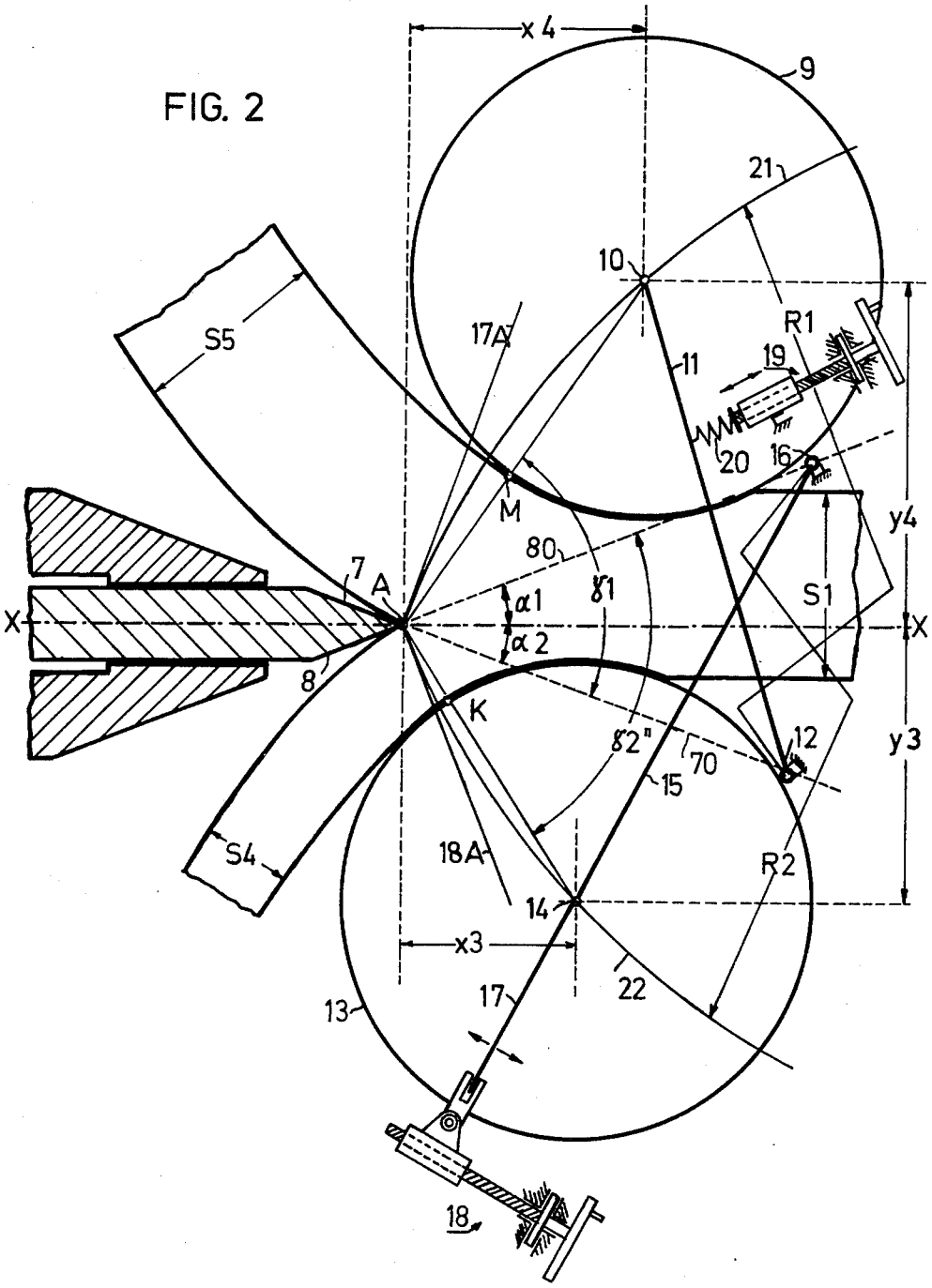
FIG. 2 shows diagrammatically the load on the band knife owing to split material in the case of a support arrangement in accordance with the invention for the feed rolls of a band knife splitting machine.

In order to be able to keep the angle gamma 1 below 90° in accordance with the invention (see FIG. 2) an upper feed roll 9 having a center 10 of rotation is carried at one end of a pivoting lever 11. The pivoting lever extends to a position below the cutting plane X—X and has its other free end pivotally carried in a fulcrum 12 with a radius R1. A lower feed roll 13 on the other hand is journalled at the end of a pivoting lever 15 for rotation above its center rotation 14. The lever 15 is for its part arranged to extend to a position above the plane X—X of cutting and has its free end pivoted for movement about a fulcrum 16 with a radius R2. The pivoting lever 15 is connected, for example via an extended end 17, with an adjusting means, as for example a threaded rod with a crank drive or the like 18 and is to check any springing movement of the lower advance or feed roll 13 during the splitting operation. Furthermore this adjusting means serves for pivoting the lever 15 within its radius R2 when the thickness of the shaved off piece S4 is to be changed, the thickness of the shaved off piece S4 being the sum of the distance between the point of contact K and the feed roll 13 and the knife edge A. In contrast to previously proposed constructions in this case the upper feed roll 9 is resiliently acted upon by a system comprising the pivoting lever 11, a conventional adjusting device, for example a crank driven threaded rod 19 so as to allow pivoting movement, while a spring 20 serves for allowing for uneveness of the material during the splitting operation. For this purpose the downwardly ejected shaved off material S4 represents the work, which is ready for further processing while the upwardly ejected material S5 is the less valuable material as normally ejected downwards in the case of conventional equipment. A particular advangage of this is that this part considered to be less valuable or waste material is directly removed from the machine and can be returned to it for immediate resplitting. This splitting operation can be repeated until the workpiece with a thickness S5 is finally smaller than the actual finished shaved off piece S4. In order to prevent any undue loading of the band knife as for example in FIG. 1 at point C and at point B, the pivot or fulcrum points 12 and 16 of the pivoting levers 11 and 15 are so arranged that the circular arcs 21 and 22 respectively described by them and therefore by the centers of rotation 10 and 14 of the feed rolls 9 and 13 make contact with straight lines 17A and 18A perpendicular to the faces 7 and 8 adjacent to the cutting edges of the band knife at the cutting edge A of the knife. As has been discovered the centers of rotation and the fulcrum points of the pivoting levers of the advance or feed rolls with respect to the cutting plane X—X are most satisfactory if they lie on the projected planes 70 and 80 of the faces 7 and 8 of the band knife adjacent to the cutting edge, that is to say for the lever of the upper feed roll on or below the plane 70 and for the lever of the lower feed roll on or above the plane 80. In this respect the distance between the band knife cutting edge A and the point of engagement M of the upper roll 9 on the surface of the shaved off piece is equal to the thickness S5 of the upper shaved off piece and a distance between the band knife cutting edge A and the point of engagement K of the lower roll on the lower surface of the shaved off pieces equal to the thickness S4 of the lower shaved off piece, and the angles alpha 1 and alpha 2 respectively included between the cutting plane X—X and the planes 70 and 80 of the faces of the cutting knife adjacent to its cutting edge are of the same size.

Since the angles of gamma 1 and gamma 2" in the arrangement of the invention cannot be larger than 90° undue loading of the band knife is out of the question. Time consuming assembly operations, occurring for example on fitting the distance sleeves or the like and removing them for increasing or reducing the thrust zone x or $x^1$, as indicated in FIG. 1, no longer occur. Since the upper feed roll 9 is carried resiliently it can become set at any desired thickness S5 of the shaved off piece of material, while the thickness S4 remains constant without any undue loading of the band knife at the point B occurring (see FIG. 1). It is also to be pointed out that the ratio of the distances of the centers 10 and 14 of rotation of the rolls 9 and 13 from the band knife cutting edge A—that is to say the distance $x^3$ and $x^4$ respectively—on the one hand and from the cutting plane X—X—that is to say distance $y^3$ and $y^4$ respectively—on the other hand, that is to say accordingly $x^4$:$y^4$ and $x^3$:$y^3$ is a function of the size of the radii R1 and R2 respectively of deflection of the pivoting levers 11 nand 15, something which accordingly changes in accordance with the thickness of the shaved off piece S1 of the material to be split for optimum splitting conditions from one case to another.

As will be seen from the above in order to allow a sufficient lifting of the two rolls, that is to say a sufficiently large vertical movement of the two feed rolls in relation to each other and on the other hand to allow a sufficiently large displacement of the point K and M respectively away and towards the knife cutting edge A, the fulcrum points 12 and 16 are arranged diagonally with respect to the centers 10 and 14, associated with them of the feed rolls 9 and 13.

In accordance with specific requirements at least of the superposed feed rolls is given a surface texture of profile in accordance with the surface of the material to be split.

What we claim is:

1. A band knife splitting machine with two superposed feed rolls and an endless moving band knife, characterized in that the two feed rolls are respectively journalled at the ends of two intersecting pivoting levers and the end of the lever for the lower feed roll is pivoted above the plane of cutting while the end of the lever for the upper feed roll is pivoted below the cutting plane.

2. A splitting machine in accordance with claim 1, characterised in that the fulcrum points of the two intersecting pivoting levers for the upper feed roll lie on or below the projected plane of the upper face of the band knife adjacent to the cutting edge and for the lever of the lower feed roll lie on or above the projected plane of the face of the band knife adjacent to the cutting edge in relation to the cutting plane.

3. A splitting machine in accordance with claims 1 or 2, characterised in that the upper feed roll is pivotally carried by the pivoting lever using a conventional setting device, for example a crank driven threaded rod and by means of a spring it is acted upon resiliently in order to compensate for uneveness of work during the splitting operation.

4. A splitting machine in accordance with claims 1 or 2, wherein the centers of rotation and pivot points of the pivot levers are so arranged that the circular arcs described by them and accordingly by the centers of rotation of the feed rolls make contact with a straight line perpendicular to the faces adjacent to the cutting edge of the band knife on the latter.

5. A splitting machine in accordance with claim 1, wherein the distance between the band knife cutting edge and the point of engagement of the upper roll on the surface of the shaved off piece of material is equal to the thickness of the piece of material taken from the top of the work and the distance between the band knife cutting edge and the point of engagement of the lower roll on the lower surface of the shaved off piece of material is equal to the thickness of the material shaved from the lower part of the work and the angles made respectively by the faces of the knife adjacent to its cutting edge with the cutting plane are of equal size.

6. A splitting machine in accordance with claim 1, wherein the ratio of the distances between the centers of rotation of the rolls from the cutting edge of the band knife on the one hand and from the cutting plane on the other hand is a function of the radii of deflection of the pivoting levers.

7. A splitting machine in accordance with claim 1, wherein at least one of the superposed feed rolls is textured in accordance with the profile of the surface of the work to be split.

* * * * *